US005292018A

United States Patent [19]

Travisano

[11] Patent Number: 5,292,018

[45] Date of Patent: Mar. 8, 1994

[54] TAMPER EVIDENT SEAL AND SYSTEM

[76] Inventor: Frank P. Travisano, 601-B Waverly Way, Jamesburg, N.J. 08831

[21] Appl. No.: 909,762

[22] Filed: Jul. 7, 1992

[51] Int. Cl.[5] ..... B65D 41/02

[52] U.S. Cl. ..... 215/246; 215/254

[58] Field of Search ..... 215/232, 246, 253, 254; 220/214, 257

[56] References Cited

U.S. PATENT DOCUMENTS

| | | | |
|---|---|---|---|
| 2,447,983 | 8/1948 | Little . | |
| 2,790,286 | 4/1957 | Snyder . | |
| 3,095,103 | 6/1963 | Harrison . | |
| 3,746,201 | 7/1973 | Fujio | 215/246 |
| 3,873,018 | 3/1975 | Donnay | 215/246 X |
| 4,363,421 | 12/1982 | Shoemaker . | |
| 4,511,052 | 4/1985 | Klein et al. . | |
| 4,652,473 | 3/1987 | Han . | |
| 5,012,940 | 5/1991 | Koehn . | |

*Primary Examiner*—Allan N. Shoap
*Assistant Examiner*—Nova Stucker

[57] ABSTRACT

A tamper evident seal and system for use on a variety of container and closure combinations providing a seal across the juncture of the container and closure and positive indication to consumers of tampering with the seal. The seal comprises a heat shrink band to which is applied at least one strip of a heat activated adhesive extending perpendicularly to the band's circumference and along the full length of the band. Perforations are provided along either edge to permit separation of the majority of the band from that portion to which the adhesive is applied. Indicia are provided on the band and on the container to indicate the presence or absence of the band. Application of the band to the container by heating causes the band to shrink into tight conformance with the container and closure obscuring the indicia thereon and bringing the adhesive into engagement with the container and closure. The heat activates the adhesive causing it to adhere that portion of the band to the container and closure across their juncture. Removal of the band will leave the adhered strip in place as a secondary safety seal and will expose indicia on the container to alert the consumer that the outer band has been removed and that the secondary safety seal should still be intact but must be broken to open the container.

31 Claims, 2 Drawing Sheets

TAMPER EVIDENT SEAL AND SYSTEM

BACKGROUND OF THE INVENTION

The present invention relates to a tamper evident seal and system for containers whereby a consumer may be assured that the seal on a product has not been tampered with prior to purchase. The invention is particularly directed to an improved tamper evident seal of the heat shrinkable sleeve or band type such as are commonly used on bottles and similar product packaging.

Heat shrink seals are in common use on a variety of products in the market place as means to reduce or prevent tampering with such products. The application of a seal occurs at the time of packaging the product after a closure has been applied to the product container and the seal generally remains intact until the ultimate purchaser removes it. In this manner the purchaser is generally assured that the product within the package is in the same condition as when it was initially packaged and has not been tampered with at any point between its manufacture and purchase.

Prior seal means have generally been limited to heat shrink collars placed over the cap and neck of a bottle and shrunk into place. Occasionally, a secondary seal or label, generally in the nature of a tax stamp, is first applied and the collar then shrunk thereover. These types of seal means are represented by U.S. Pat. No. 2,447,983 to Little, U.S. Pat. No. 2,790,286 to Snyder and U.S. Pat. No. 3,095,103 to Harrison. The Little patent discloses a heat shrinkable sleeve having an opaque portion and a transparent portion which is designed to be used in combination with a tax stamp placed over the package closure. The sleeve is oriented so that the tax stamp shows through the transparent portion. Snyder discloses a secondary closure in the nature of a shrink wrap sleeve which is dipped in a swelling agent to render the sleeve tacky so that it will adhere to the container when shrunk. As an alternative, Snyder also discloses that a heat activatable adhesive may be coated on the inner surface of the sleeve instead of using the swelling agent. Although the present invention also employs a heat activatable adhesive, there are other aspects which are neither disclosed nor suggested by the Snyder patent and which will become clear in the subsequent discussion. The Harrison patent discloses a heat shrink closure or seal which is applied in combination with a tear strip, the shrinking of the seal material serving to hold the tear strip in place. However, the tear strip is not itself adhered to the container.

Such prior art seals have a significant drawback in that it is possible to remove the heat shrink collar, tamper with the contents of the package then replace the collar, either with the original or a new one. Even in the case of the Little structure, the tax stamp may be easily slit and reglued. Counterfeit tax stamps have also been known to be used. In the case of Snyder, the entire sleeve could be easily removed and replaced.

Other methods of providing evidence of tampering or prior opening of packages comprise seal strips adhered across the junctures of closures and containers as shown in the patents of Shoemaker, U.S. Pat. No. 4,363,421 and Koehn, U.S. Pat. No. 5,012,940. In both of these patents, seal strips are provided which span the space between a closure and its container so as to be ruptured upon opening of the container, thereby providing evidence of such opening. However, in the Shoemaker patent only the ends of the strip are adhered to the package and may therefor be freed and re-adhered. The system of Koehn requires that the closure have a specific structure which works with the adhesive strip to provide tamper protection. In contrast, the present invention provides a tamper evident seal means which may be used on any closure/container combination and which renders extremely difficult the unobvious removal and replacement of a heat shrink seal means.

Still other seals and methods employ color change compositions or two part tape means whereby removal, or attempted removal results in the exposure of a color change composition or indicia associated with the seal means such that warning of the prior opening is given to the purchaser by a color change or the exposure of indicia which is part of the tape. These types of seals are represented in the prior art by U.S. Pat. No. 4,511,052 to Klein, et al., which discloses a color change means, and U.S. Pat. No. 4,652,473 to Han, which discloses a two part tape having an exposable color or indicia bearing portion adjacent an adhesive and which is thin and deformable when removal is attempted. However, in Han the indicia is part of the sealing tape and there is nothing to restrict its complete removal and replacement with an alternative band also there is nothing to indicate to the consumer that a secondary safety seal should have been present. Similarly, the color change tape of Klein, et al., may also be completely removed leaving no indication to the consumer of evidence of tampering.

SUMMARY OF THE INVENTION

It is an object of this invention to provide a tamper evident seal which is simple to use and which resists attempts at surreptitious removal and replacement.

It is a further object of this invention to provide a tamper evident seal of the heat shrink type which includes a means to positively retain at least part of a heat shrink sleeve in place on a package upon the removal or attempted removal of the seal.

It is an even further object of this invention to provide a tamper evident seal system which includes specific indicia positioned on a package so as to be obscured from view until removal of a portion of the seal means.

It is a still further object of this invention to provide a method whereby such a tamper evident seal means may be easily and economically produced.

Further objects will become evident from the following discussion and drawings.

The present invention provides a tamper evident seal system which comprises, in combination, a container having a removable closure and a tamper indicating seal means applicable over the container and closure, wherein the seal means comprises a sleeve or band of heat shrinkable material of a size to extend over the closure and at least the adjacent portion of the container to include an area below the neck, and including at least one strip of heat activated adhesive material on the inner surface of the band. Preferably, the strip of heat activated adhesive material is perpendicular to the circumference of the band and extends across the width of the band to be interposed between the band and the container and its closure whereby the strip will adhere to both the closure and the container and will span the juncture therebetween when the band is applied thereto.

In addition, the present invention presents a tamper evident seal for a container having a removable closure wherein the seal comprises a band of opaque heat shrinkable material for application over the container and closure, at least one strip of heat activated adhesive material applied to the inner surface of the band and extending from one open edge of the band to the opposite open edge of the band so that the application of heat to shrink the band also softens or activates the strip which is then pressed against the container and closure by the shrinking band and positively adheres that portion of the band to the container and closure. Means is also provided whereby the area defined by the adhesive strip is separable from the band upon the authorized removal or attempted surreptitious removal of the band. The strip remains adhered to the package and indicia is uncovered which specifically notes that the band has been removed and that the strip must be broken to open the package.

Furthermore, the present invention provides a method of making and applying a tamper evident seal for a container and closure wherein the container and closure bear indicia to indicate the presence and removal of the seal and comprising providing a band of heat shrinkable material and applying at least one strip of heat activated adhesive material on the inner surface of the band, providing means whereby the band may separate adjacent the edges of the adhesive strip, placing the band and strip combination over a combination container and closure such that the band covers the indicia and heating the band to cause it to shrink into tight engagement with the container and closure so that the strip is brought into intimate engagement with the container and closure and is caused to adhere to them across the juncture therebetween. The band is provided with means whereby the strip will remain adhered to the container and closure upon removal of the band.

DETAILED DESCRIPTION OF THE INVENTION

Figure 1:
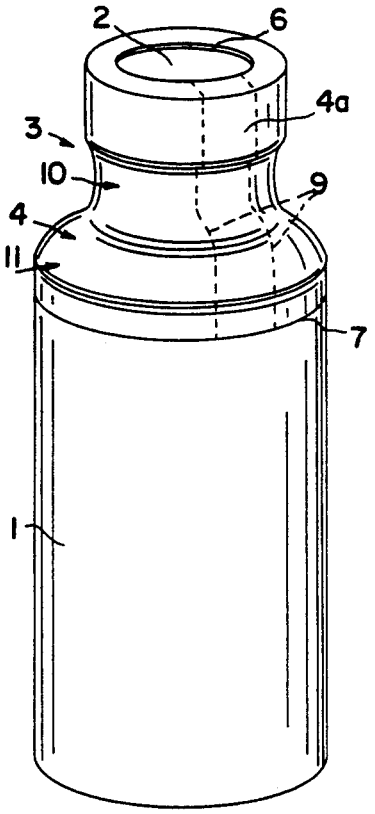
FIG. 1 is an oblique view of a bottle and cap with the safety seal of the present invention thereon.
Figure 2:
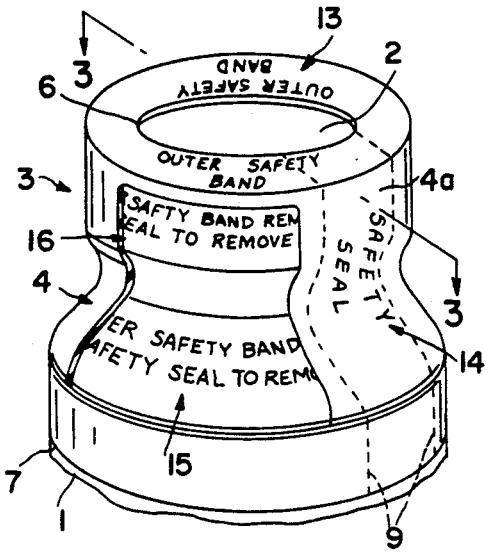
FIG. 2 is an enlarged view of the cap and shoulder area of the bottle of FIG. 1 with a portion of the outer safety band removed to show the bottle and cap indicia.

The present invention provides an improved, cost effective, one step application, external tamper evident seal and system which is achieved by the modification of commonly used heat shrink bands and will be described in combination with a bottle and threaded cap, although it would be suitable for use on other types of packages or containers including bottles with snap on caps, bayonet closures, two part containers, bottles without a defined neck area, and the like. FIG. 1 illustrates the basic arrangement of the system in place on a bottle; the system comprising a bottle 1, cap 2 and seal 3. As more clearly shown in FIGS. 2 and 3, the seal 3 comprises a band or sleeve 4 of heat shrink material on the inner surface of which is applied at least one strip 5 of an adhesive material, preferably a heat-activated adhesive. This strip extends across the band 4 from the top edge 6 to the bottom edge 7 and is preferably perpendicular to the circumference of band 4 as shown. The entire band 4 provides a primary seal over the cap 2 and bottle 1, forming the outer safety band, while the adhesive strip 5 defines a portion of band 4 which is adhered to the bottle 1 and cap 2 and which forms a secondary or safety seal 4*a* which remains in place upon removal of the rest of band 4. Accordingly, the strip 5 must be of sufficient width and adhesion to result in a readily observable and strong seal which will not separate from the cap and bottle upon removal of the band. The width of the strip will be dependent on the size of the package on which the seal is applied, but it should be at least ¼" in width and cover no more than 50% of the entire inner surface area of band 4. Preferably, strip 5 will be between ¼" and 1" in width.

Alternatively, there may be provided a plurality of strips 5 spaced about the inner circumferential surface of band 4, usually equidistantly thereabout. Thus if two strips 5 are provided they will preferably be opposite each other and if three are present they will preferably be spaced 120° apart. Although the seal means is adequate with one strip 5, multiple strips provide added security against tampering and/or attempted surreptitious removal and replacement of the seal. Where multiple strips are used, their total area should not exceed 50% of the entire inner surface area of band 4.

Figure 3:
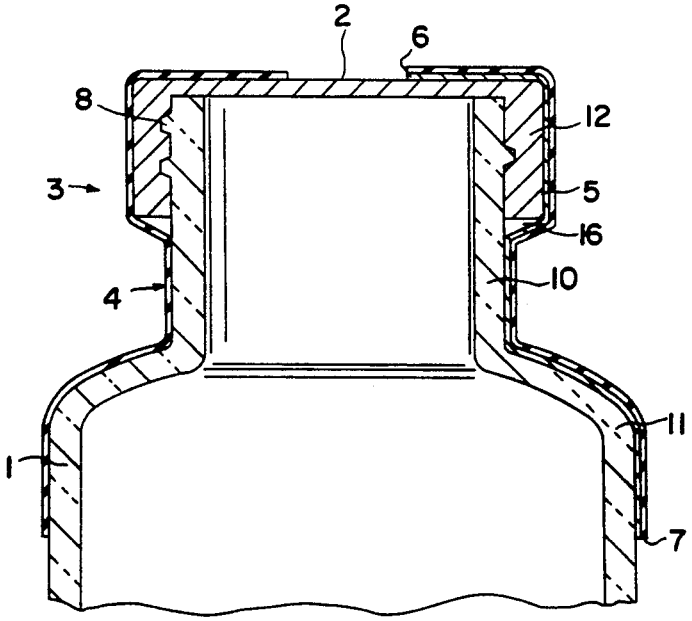
FIG. 3 is a vertical cross section of FIG. 2 taken along line 3—3.

In addition, although a perpendicular arrangement is preferred for the strip 5, they may be oriented at an angle to the circumference of band 4. Such an angle should preferably be no greater than 45° from the vertical in either direction. Also, if strip 5 is to be angled it is preferred that it be in the direction opposite that of removal of the cap 2 where the attachment of cap 2 to bottle 1 is by means of cooperating threads 8 as shown in FIG. 3. Such an angled orientation will provide a positive resistance against removal of the cap 2 as an additional indication to consumers that the secondary seal 4*a* is intact and that the seal means 3 has not been completely broken.

Figure 4:
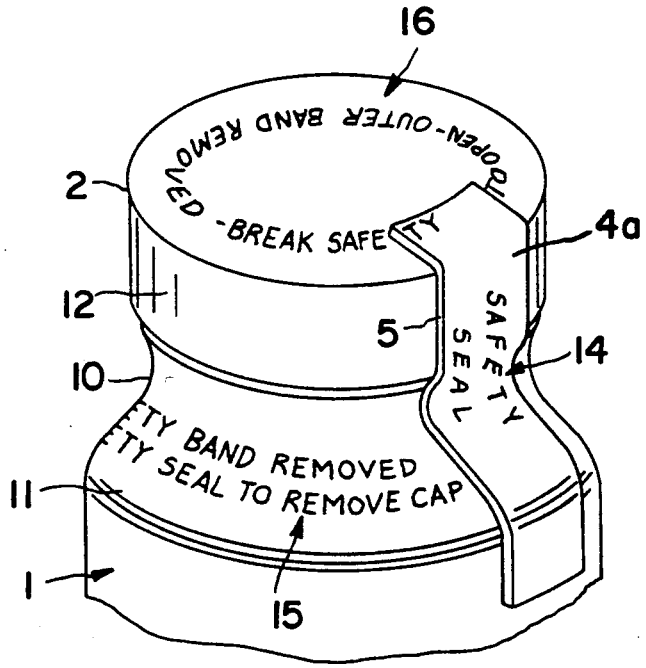
FIG. 4 is an oblique view of the cap and shoulder area of the bottle of FIG. 1 with the outer safety band removed and the safety seal strip adhered in place.

To allow separation of band 4 from secondary seal 4*a* which is defined by strip 5 and the portion of band 4 to which it is applied, band 4 is provided with separation means 9 in the form of lines of weakening or perforations preferably along both edges of strip 5. Other separation means such as tear strips, strings or the like may also be used. Where multiple strips are used, each may be provided with such separation means 9. The purpose of the separation means 9 is to facilitate the separation of the outer safety band 4 from secondary seal 4*a* without inadvertently breaking either secondary seal 4*a* or the adhesion of strip 5 with bottle 1 and cap 2. In this manner removal of the band 4 will leave secondary seal 4*a* in place while revealing indicia printed or otherwise applied to the cap or bottle as shown in FIG. 4. Although it is preferred that separation means 9 be provided along both edges of strip 5, a single separation means 9 may suffice where the adhesion strength of strip 5 is greater than the tear strength of band 4. In such cases, the band 4 may be separated at separation means 9 and then torn off along the edge of adhesive strip 5, or the ends of band 4 may be left and secondary seal 4*a* otherwise broken for removal of cap 2.

Returning to FIGS. 1, 2 and 3, seal 3 is preferably of a length to extend from an area inward of the edge of cap 2 downward over the neck 10 and shoulder 11 of bottle 1. Prior heat shrink seals have generally only covered the skirt 12 of cap 2 and the neck 10 of bottle 1.

Band 4 has an upper edge 6 and does not completely cover the upper surface of cap 2 thereby permitting the seal means 3 to be used in conjunction with button caps wherein a pop-up botton is provided as an indication that a pressure seal on the package has been broken.

As part of the system of the present invention, indicia are provided on seal means 3 as well as bottle 1 and cap 2 to instruct the consumer as to the proper relationship of the parts of the system. Indicia 13, 14 on seal means 3 preferably identify band 4 and secondary seal 4a, respectively. Wording such as "OUTER SAFETY BAND" and "SAFETY SEAL", respectively, may be used or other appropriate wording to identify band 4 and secondary seal 4a. Bottle 1 and cap 2 are also provided with indicia, 15 and 16 respectively, to signify that outer hand 4 has been removed and that the consumer must break the secondary seal 4a in order to open the package or remove cap 2. Language such as, "OUTER SAFETY BAND REMOVED—BREAK SAFETY SEAL TO REMOVE CAP" may be used or any other wording to indicate the removal of band 4 and the need to break secondary seal 4a. It is preferred that indicia 15 and 16 on both bottle 1 and cap 2 be used, although at the very least indicia 15 on bottle 1 must be present within the system since it is far more difficult to switch a complete package than it would be to merely substitute a different cap. Placing the indicia on the bottle rather than on a second layer of a shrink band also prevents the complete removal of all indicia related to a safety seal. Indicia 15 is preferably applied to the shoulder area 11 of bottle 1 while indicia 16 on cap 2 may be applied to skirt 12 or to the top surface of cap 2 as shown in FIG. 4. Wherever indicia 15 and 16 are placed they must be in a position so as to be covered by band 4 when it is applied and clearly evident to the consumer when band 4 is removed.

The manufacture of seal means 3 is preferably by extrusion of the heat shrink material through a die to form cylindrical band 4. Such a die may be provided with means to produce the separation means 9 as the band is extruded. Adhesive strip 5 is preferably co-extruded onto the inner surface of band 4 at the same time, the nozzle for the material of strip 5 being aligned so as to be bounded by the means used to produce the separation means 9 which is associated with the band die. The material from which band 4 is produced may be any commonly used heat shrink material but is preferably an opaque polyvinylchloride film. One such film is GENOTHERM GZ 44, marketed by American Hoechst. Such materials may be extruded and oriented into any shape or arrangement needed. The material forming strip 5 is preferably a heat activated adhesive which may be co-extruded with band 4 or otherwise printed or laminated to the band 4 material and which activates at the temperature at which the band material shrinks. Examples of such adhesives are KAN TAK No. 34-4987 and INSTANT-LOK NO. 34-4977 produced by National Starch and Chemical Co. However, other adhesives which may be extruded, printed or otherwise applied to heat shrinkable materials and which have an adhesion strength greater than the tear strength of band 4, such as pressure activated adhesives, radiation activated adhesives, solvent adhesives and the like, may also be used. The thickness of the band 4 material is preferably 0.001" to 0.003" while the heat activated adhesive is applied in a thickness of 0.0005" to 0.002".

As an alternative to co-extrusion, the band 4 material may be formed in a sheet and the adhesive material of strip 5 printed or otherwise laminated thereto after which the sheet may be rolled into the cylinder form of band 4 with the overlapping edges secured by any suitable means. The separation means 9 may be formed or applied before or after the application of adhesive strip 5 and preferably before the sheet is rolled. In addition, the indicia 13 and 14 associated with band 4 and secondary seal 4a may be printed on the heat shrink material before or after the application of adhesive strip 5. Any method of printing may be used including such methods as offset, intaglio, ink jet or the like. Where band 4 is formed by extrusion, any appropriate printing method may also be used to apply the necessary indicia 13 and 14 thereto either in conjunction with extrusion or after it. In addition, printing or dye means may be applied to render the area of secondary seal 4a a different or contrasting color to that of band 4.

With regard to indicia 15 and 16 applied to bottle 1 and cap 2, these may be printed onto bottle 1 and cap 2 by standard means or they may be applied through the medium of band 4. To achieve this alternative application of indicia 15 and 16, the wording therefor is applied to the inner surface of band 4 in reverse using an ink which will transfer to bottle 1 and cap 2 upon the application of heat and/or pressure when band 4 is shrunk to fit. In addition, the ink may have the property of changing color when exposed to light or air after activation by heat or pressure.

Application of the seal means 3 to a package such as the bottle 1 and cap 2 combination shown is achieved by first forming the seal means 3 either by co-extrusion of band 4 material and strip 5 adhesive or by rolling a flat laminated sheet of band 4 material and strip 5 adhesive into a cylinder. The thus formed seal means 3 is then applied over the bottle 1 and cap 2 combination and exposed to heat thereby causing band 4 to shrink into tight engagement with bottle 1 and cap 2. The shrinkage of band 4 will preferably be of a degree such that the material will conform closely to the outer configuration of the bottle 1 and cap 2 as shown in FIG. 3. Such close conformation will in turn cause adhesive strip 5 to be pressed against bottle 1 and cap 2 and across the juncture 16 therebetween and to also achieve a tight engagement with bottle 1 and cap 2. The heat used to shrink band 4 will also activate the adhesive of strip 5 while the pressure caused by the shrinkage of band 4 will provide a clamping force to ensure a good adhesion of strip 5 to the bottle 1 and cap 2. Where a pressure sensitive adhesive is used, the clamping pressure of the shrinking band will cause adhesion. In the case of radiation activated adhesives, the band may be subjected to appropriate wavelengths of radiation before or after shrinkage. Since band 4 is provided with separation means 9, preferably along each edge of adhesive strip 5, and since only the area of band 4 covered by adhesive strip 5 is positively adhered to bottle 1 and cap 2, any attempt to remove seal 3 will result in band 4 tearing at the separation means 9 or otherwise along the edges of strip 5, thereby leaving secondary seal 4a in place across the juncture 16 of bottle 1 and cap 2 as a secondary safety seal or validator. Furthermore, removal of band 4 exposes indicia 15 and 16 thereby alerting the consumer to the removal and to the fact that the secondary safety seal 4a must be broken to remove the cap 2.

Consumer interaction with the seal 3 of this invention is a three step process. First, with the seal 3 in place, the consumer assumes that the outer safety band 4 is the original, the unbroken separation means 9 will confirm this as well as the fact that the consumer is the one to break and remove the outer safety band 4. Secondly, when the outer safety band 4 is removed, the indicia 15, 16 on the bottle 1 and cap 2 will be exposed to tell the consumer that there should have been an outer safety band 4. Thirdly, removal of the outer safety band 4 leaves the positively adhered secondary safety seal 4a in place and the indicia 15, 16 instruct the consumer to break this seal in order to remove the cap 2. Thus, the consumer is positively alerted to the fact that there should have been an outer safety band and a secondary safety seal and that if one or the other are missing then there has been at least an attempt to tamper with the contents of the bottle.

The foregoing describes the preferred embodiment of the present invention. Any modifications or changes which may become apparent to those skilled in the art are deemed to be included within the scope of the following claims.

What is claimed is:

1. A tamper evident seal system comprising, in combination, a container having a removable closure and a tamper indicating seal applied over said container and closure, said seal comprising a band of heat shrinkable material of a size to encircle said container and closure and to extend over said closure and an adjacent portion of said container, and at least one strip of adhesive material on the inner surface of said band interposed between said band and said container and closure said strip of adhesive having a width narrower than the circumference of said band and extending transversely across said band whereby that portion of said band on which said adhesive is located is positively adhered to said container and closure and across the juncture between said container and closure.

2. A tamper evident seal system comprising, in combination, a container having a removable closure and a tamper indicating seal applied over said container and closure, said seal comprising a band of heat shrinkable material of a size to extend circumferentially around and longitudinally over said closure and an adjacent portion of said container, and at least one strip of adhesive material on the inner surface of said band interposed between said band and said container and closure whereby that portion of said band having said strip of adhesive material is positively adhered to said container and closure wherein said strip of adhesive material has a width less than the circumferential extent of said band and is at an angle of between 45° and 135° from horizontal extending across said band whereby said strip adheres said portion of said band to said closure and said container and spans the juncture between said closure and said container.

3. The tamper evident seal system of claim 2 wherein said heat shrinkable material is opaque.

4. The tamper evident seal system of claim 3 wherein said container and closure bear indicia to indicate removal of said band, said indicia being located so as to be obscured by said band when said band is in place over said container and closure.

5. The tamper evident seal system of claim 4 wherein said portion of said band defined by the location of said strip of adhesive material is a color contrasting with the appearance of the remainder of said band.

6. The tamper evident seal system of claim 4 wherein said band is provided with separation means whereby said band may be broken and separated from said portion of said band associated with said adhesive strip.

7. A tamper evident seal for a container having a removable closure wherein said seal comprises:

a band of heat shrinkable material having an inner surface and an outer surface and circumferentially applicable over said container and closure;

at least one strip of adhesive material applied to the inner surface of said band transverse to and having a width less than the circumference of said band and extending from one open edge of said band to the opposite edge of said band and capable of adhering to said container and said closure and across the juncture therebetween upon application of said band; and means on the outer surface of said band to distinguish an area of said band associated with said adhesive from an area of said band not associated with said adhesive.

8. The tamper evident seal of claim 7 wherein said band is provided with transverse separation means parallel to said at least one strip of adhesive permitting said band to separate therealong whereby said area of said band not associated with said adhesive is separable from said area of said band associated with said adhesive and is removable from said container and closure while said strip of adhesive and said area of said band associated therewith remain in place on said container and closure thereby providing a secondary safety seal.

9. The tamper evident seal of claim 8 wherein said band is opaque.

10. The tamper evident seal of claim 9 wherein said means to distinguish said area of said band associated with said adhesive comprises a color contrasting with the appearance of the remainder of said band.

11. The tamper evident seal of claim 9 wherein said means to distinguish said area of said band associated with said adhesive comprises printed indicia identifying said area.

12. The tamper evident seal of claim 9 wherein said band is an extruded polymer film.

13. The tamper evident seal of claim 12 wherein said adhesive strip is coextruded with said film.

14. The tamper evident seal of claim 12 wherein said adhesive strip is applied to said film by printing means.

15. The tamper evident seal of claim 12 wherein said adhesive is a preformed strip and is laminated to said film after extrusion.

16. The tamper evident seal of claim 12 wherein said film is an extruded polyvinylchloride and said adhesive strip is a hot melt material coextruded with said film and is heat activated.

17. A tamper evident seal system in combination with a container having a removable closure, said seal system comprising:

a band of heat shrinkable material having an inner surface and an outer surface and being circumferentially applicable over said container and closure;

at least one strip of adhesive material applied to the inner surface of said band transverse to and having a width less than the circumference of said band and capable of adhering to said container and closure and across the juncture therebetween when said band is applied over said container and closure;

means on the outer surface of said band to distinguish the portion of said band to which the adhesive is applied from the portion of said band to which the adhesive is not applied; and indicia on said container to indicate removal of said band wherein said band is of a length to cover and obscure said indicia when said band is shrunk in place over said container and closure and whereby said portion of said band to which adhesive is applied forms a secondary safety seal remaining on said container and closure upon removal of said portion of said band to which adhesive is not applied.

18. A tamper evident seal and system comprising, in combination, a cylindrical band of heat shrinkable material having at least one strip of adhesive material on the inner surface of said band, said strip extending transversely across said band from one edge thereof to the opposite edge thereof and at an angle no greater than 45° from vertical and said band having separation means permitting said band to separate at a location apart from said at least one strip of adhesive material; and a combination container and closure having indicia thereon to indicate the absence of said band;

said band having a circumference and a length fitting over said container and closure and covering said indicia when said band is heat shrunk into tight engagement with said container and closure, said tight engagement causing said strip of adhesive to engage said container and closure and adhere thereto across the junction therebetween, and said separation means being substantially parallel to said strip of adhesive, whereby separation of said band along said separation means permits removal of said band and exposure of said indicia, while said adhesive strip and at least a portion of said band associated therewith remains adhered to said container and said closure and across the juncture therebetween to form a secondary seal across said juncture.

19. The tamper evident seal and system of claim 18 wherein said container comprises a bottle having a body, a shoulder and a reduced diameter neck having means to accept said closure, said indicia indicating absence of said band is located on said shoulder and wherein said band extends over said closure and said bottle to a point on said body below said shoulder whereby said indicia is completely covered by said band.

20. The tamper evident seal and system of claim 18 wherein said adhesive strip is printed on said band.

21. The tamper evident seal and system of claim 18 wherein said adhesive strip is performed and is laminated to said band.

22. The tamper evident seal and system of claim 18 further comprising identifying indicia on said band and said secondary seal whereby said secondary seal is distinguished from said band.

23. The tamper evident seal and system of claim 22 wherein said identifying indicia on said band and said secondary seal comprise contrasting colors.

24. The tamper evident seal and system of claim 18 wherein said band is an extruded polymer film.

25. The tamper evident seal and system of claim 24 wherein said adhesive strip is co-extruded with band.

26. The tamper evident seal and system of claim 18 wherein said indicia is applied to said container and closure by an ink applied to the inner surface of said band and capable of transferring from said band to said container and closure under the influence of heat applied to shrink said band.

27. The tamper evident seal and system of claim 26 wherein said indicia exhibits a color change upon exposure to light following activation by heat.

28. The tamper evident seal and system of claim 26 wherein said indicia exhibits a color change upon exposure to air following activation by heat.

29. The tamper evident seal and system of claim 18 wherein said indicia is applied to said container and closure by an ink applied to the inner surface of said band and capable of transferring from said band to said container and closure under the influence of pressure applied by said band upon shrinkage.

30. The tamper evident seal and system of claim 29 wherein said indicia exhibits a color change upon exposure to light following activation by pressure.

31. The tamper evident seal and system of claim 29 wherein said indicia exhibits a color change upon exposure to air following activation by pressure.

* * * * *